US009568188B2

(12) United States Patent
Kim

(10) Patent No.: US 9,568,188 B2
(45) Date of Patent: Feb. 14, 2017

(54) GAS CONTAINER CONNECTING ADAPTER

(71) Applicant: KOVEA CO., LTD., Bucheon-si (KR)

(72) Inventor: Sang Hyun Kim, Incheon (KR)

(73) Assignee: KOVEA CO., LTD. (KR)

( * ) Notice: Subject to any disclaimer, the term of this patent is extended or adjusted under 35 U.S.C. 154(b) by 7 days.

(21) Appl. No.: 14/741,799

(22) Filed: Jun. 17, 2015

(65) Prior Publication Data

US 2016/0018033 A1 Jan. 21, 2016

(30) Foreign Application Priority Data

Jul. 16, 2014 (KR) ..... 10-2014-0089580

(51) Int. Cl.
*F16L 21/02* (2006.01)
*F23D 14/28* (2006.01)
*F23D 14/38* (2006.01)

(52) U.S. Cl.
CPC ..... *F23D 14/28* (2013.01); *F23D 14/38* (2013.01)

(58) Field of Classification Search
CPC ..... F23D 14/28; F23D 14/38
USPC ..... 222/3; 285/351
See application file for complete search history.

(56) References Cited

U.S. PATENT DOCUMENTS 3,475,110 A * 10/1969 Suchowolec ..... F23D 91/02 137/599.01
4,332,550 A * 6/1982 Baumann ..... F23D 14/28 251/215
4,348,172 A * 9/1982 Miller ..... F23Q 3/002 431/255
5,609,370 A * 3/1997 Szabo ..... F16L 37/0985 285/319
5,647,738 A * 7/1997 Tsai ..... F23D 14/28 431/247
2003/0211435 A1* 11/2003 Long ..... F23D 11/443 431/247

FOREIGN PATENT DOCUMENTS

JP 57096897 12/1980
JP 08014532 1/1996
JP 08014532 A * 1/1996

* cited by examiner

*Primary Examiner* — Donnell Long
(74) *Attorney, Agent, or Firm* — Cantor Colburn LLP

(57) ABSTRACT

A gas container connecting adapter includes: a body coupled to a gas container by a gas container coupling unit, having a gas supply passage, and configured to discharge gas supplied from the gas container; and a sealing unit provided at an inlet of the gas supply passage, configured to prevent gas supplied from the gas container coupled to the gas container coupling unit, from leaking to the outside of the gas supply passage, and having a plurality of sealing means selectively contacting a nozzle of the gas container according to a shape of the nozzle. With such a configuration, the gas container connecting adapter can prevent gas leakage to the outside, by maintaining a sealed state even when gas containers of various shapes are coupled to the single gas container connecting adapter.

3 Claims, 8 Drawing Sheets

GAS CONTAINER CONNECTING ADAPTER

BACKGROUND OF THE INVENTION

Field of the Invention

The present invention relates to a gas container connecting adapter, and more particularly, to a gas container connecting adapter capable of maintaining a sealed state even when connected to gas containers of various shapes.

Background of the Invention

Generally, portable and mobile gas equipment used at home or outdoors is provided with a portable gas container where fuel is filled, such as a butane gas container.

Since most of gas containers are fabricated in correspondence to international standards, a user can purchase the gas container anywhere in the world, and can use it conveniently.

FIG. 1 is a perspective view illustrating a structure of a gas torch including a gas container connecting adapter in accordance with the conventional art, and FIG. 2 is a sectional view illustrating an inner structure of the gas torch including the gas container connecting adapter shown in FIG. 1.

As shown, the conventional portable gas injection device includes a body 1 having a ¬-shape; a gas controlling opening 2 formed at one side of the body 1, and configured to control an amount of gas to be discharged so that a size of flame can be controlled; a connection adapter 3 formed to be detachably mounted to a portable gas container; and a pipe-type fuel intake 4 installed at an end part of the body 1. As shown in FIG. 2, a controller 6 and a ¬-shaped supply pipe 5 are installed in the body 1. The controller 6 is configured to guide gas supplied from the portable gas container coupled to the connection adapter 3, and to control a gas amount. An injection nozzle 7 for injecting gas is installed at the '¬'-shaped supply pipe 5. An ignition device 8, configured to ignite gas emitted to be discharged to the supply pipe 5, is installed. A flame maintaining opening 9, configured to maintain flame as gas emitted from the injection nozzle 7 is combusted, is installed in the fuel intake 4.

In the conventional gas injection device, gas is moved through the supply pipe 5, from the portable gas container mounted to the connection adapter 3. Then, the gas is sprayed by the injection nozzle 7. The sprayed gas is combusted at a front end part of the flame maintaining opening 9 of the fuel intake 4, thereby generating flame.

As an amount of gas to be supplied to the supply pipe 5 is controlled by the controller 6 and the gas controlling opening 2, a size of flame is controlled.

Further, an O-ring for preventing supplied gas from leaking to the outside is provided in the connection adapter 3 to which the portable gas container is coupled.

The O-ring is formed to have the same diameter as a nozzle of the portable gas container, so as to be adhered to an outer surface of the nozzle. The O-ring is provided in one in number.

However, the conventional gas injection device may have the following problems.

Firstly, the gas container is coupled to the connection adapter 3 integrally provided at one side of the gas injection device, and then an ignition process is executed by the ignition device 8. The gas container coupled to the connection adapter 3 is limited to have a specific shape. For instance, the gas container is implemented as a butane gas container, etc. Thus, gas containers of various shapes cannot be coupled to the connection adapter 3. This may lower compatibility.

Further, a single O-ring, which has the same diameter as a nozzle of a butane gas container of a specific shape, is provided in the connection adapter 3. Thus, if the connection adapter 3 is coupled to another gas container having a different nozzle size from the gas container, gas may leak to the outside and an accident may occur.

SUMMARY OF THE INVENTION

Therefore, an aspect of the detailed description is to provide a gas container connecting adapter capable of preventing gas leakage to the outside, by maintaining a sealed state even when gas containers of various shapes are coupled to the single gas container connecting adapter.

To achieve these and other advantages and in accordance with the purpose of this specification, as embodied and broadly described herein, there is provided a gas container connecting adapter, including: a body coupled to a gas container by a gas container coupling unit, having a gas supply passage, and configured to discharge gas supplied from the gas container; and a sealing unit provided at an inlet of the gas supply passage, configured to prevent gas supplied from the gas container coupled to the gas container coupling unit, from leaking to the outside of the gas supply passage, and having a plurality of sealing means selectively contacting a nozzle of the gas container according to a shape of the nozzle.

The sealing means may include: a first O-ring disposed at an upper side so as to contact a nozzle formed to be relatively short and thin, and formed to have a relatively small diameter; and a second O-ring disposed below the first O-ring so as to contact a nozzle formed to be relatively long and thick, and formed to have a relatively large diameter.

A separation preventing plate, which has a nozzle insertion hole penetratingly-formed at a central part thereof, may be provided between the first O-ring and the second O-ring for prevention of separation of the first O-ring.

A lower circumferential surface of the nozzle insertion hole may be provided with an inclined surface formed to be tapered in order to prevent an upper surface of the nozzle being inserted from being locked to a circumferential surface of the nozzle insertion hole.

The gas container connecting adapter according to the present invention can have the following advantages.

As aforementioned, the gas container connecting adapter can prevent gas leakage to the outside, by maintaining a sealed state even when gas containers of various shapes are coupled to the single gas container connecting adapter.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a gas torch according to an embodiment of the present invention will be explained in more detail with reference to the attached drawings.

Figure 1:
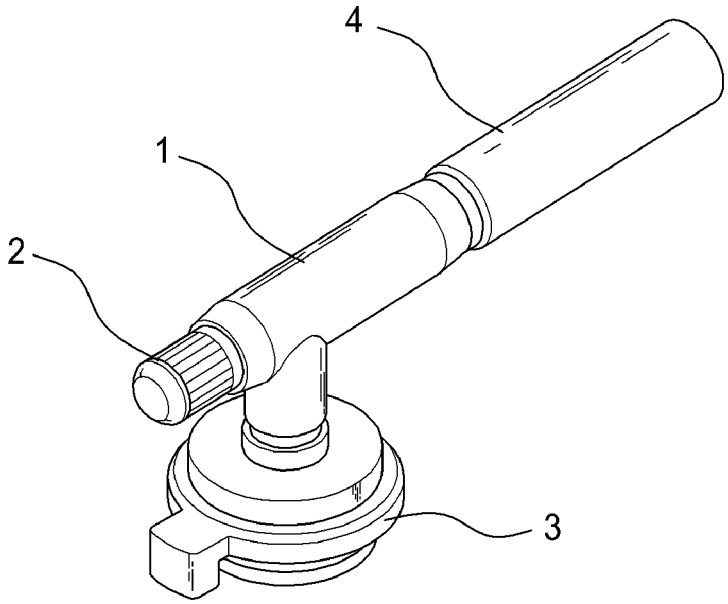
FIG. 1 Prior Art
FIG. 1 is a perspective view illustrating a structure of a gas torch including a gas container connecting adapter in accordance with the conventional art.
Figure 2:
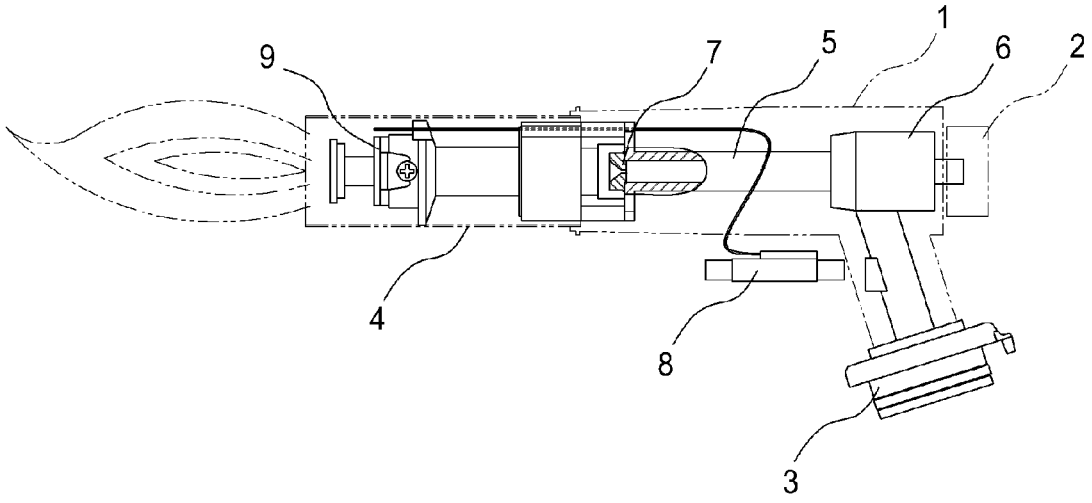
FIG. 2 Prior Art
FIG. 2 is a sectional view illustrating an inner structure of the gas torch including the gas container connecting adapter shown in FIG. 1.
Figure 3:
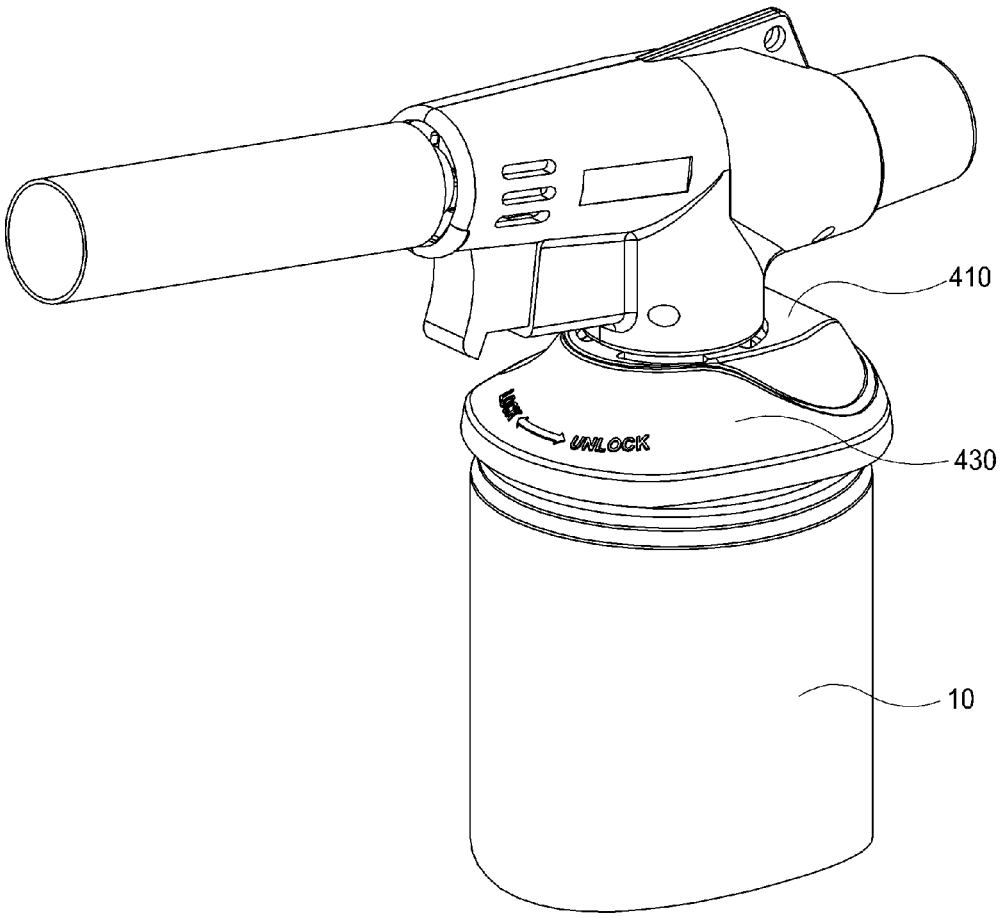
FIG. 3 is a perspective view illustrating a structure of a gas container connecting adapter according to an embodiment of the present invention.
Figure 4:
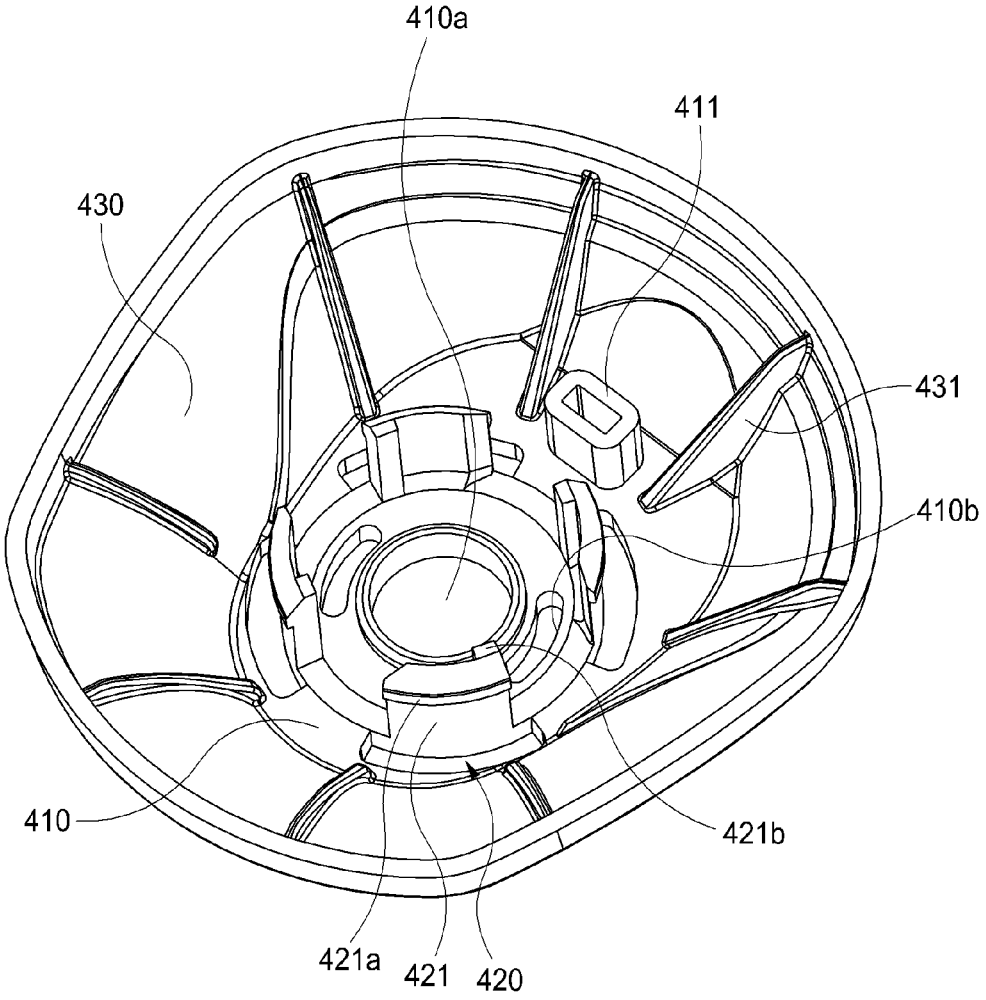
FIG. 4 is a perspective view illustrating an inner structure of the gas container connecting adapter shown in FIG. 3.
Figure 5:
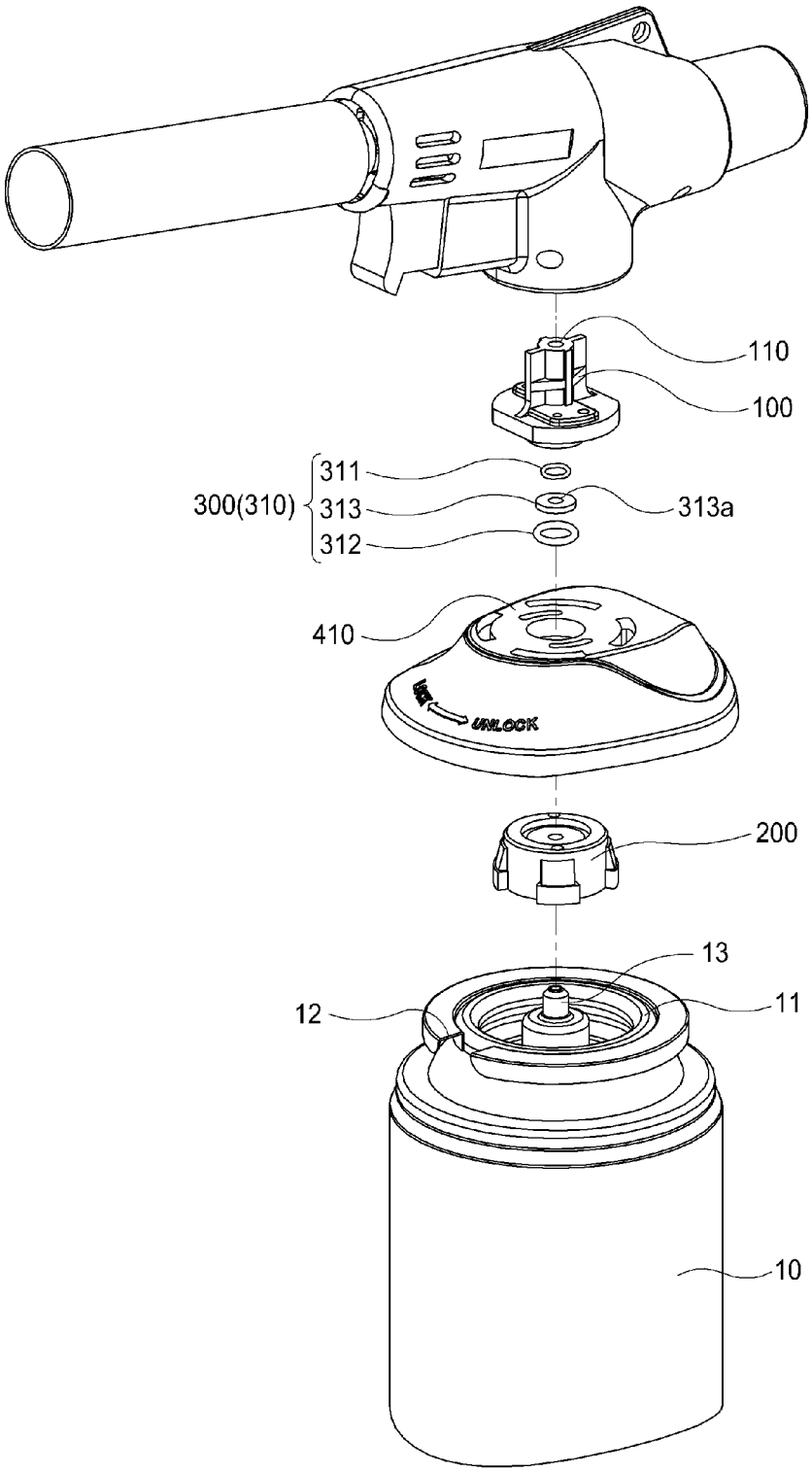
FIG. 5 is an exploded perspective view illustrating that a butane gas container is coupled to a gas container connecting adapter according to an embodiment of the present invention.
Figure 6:
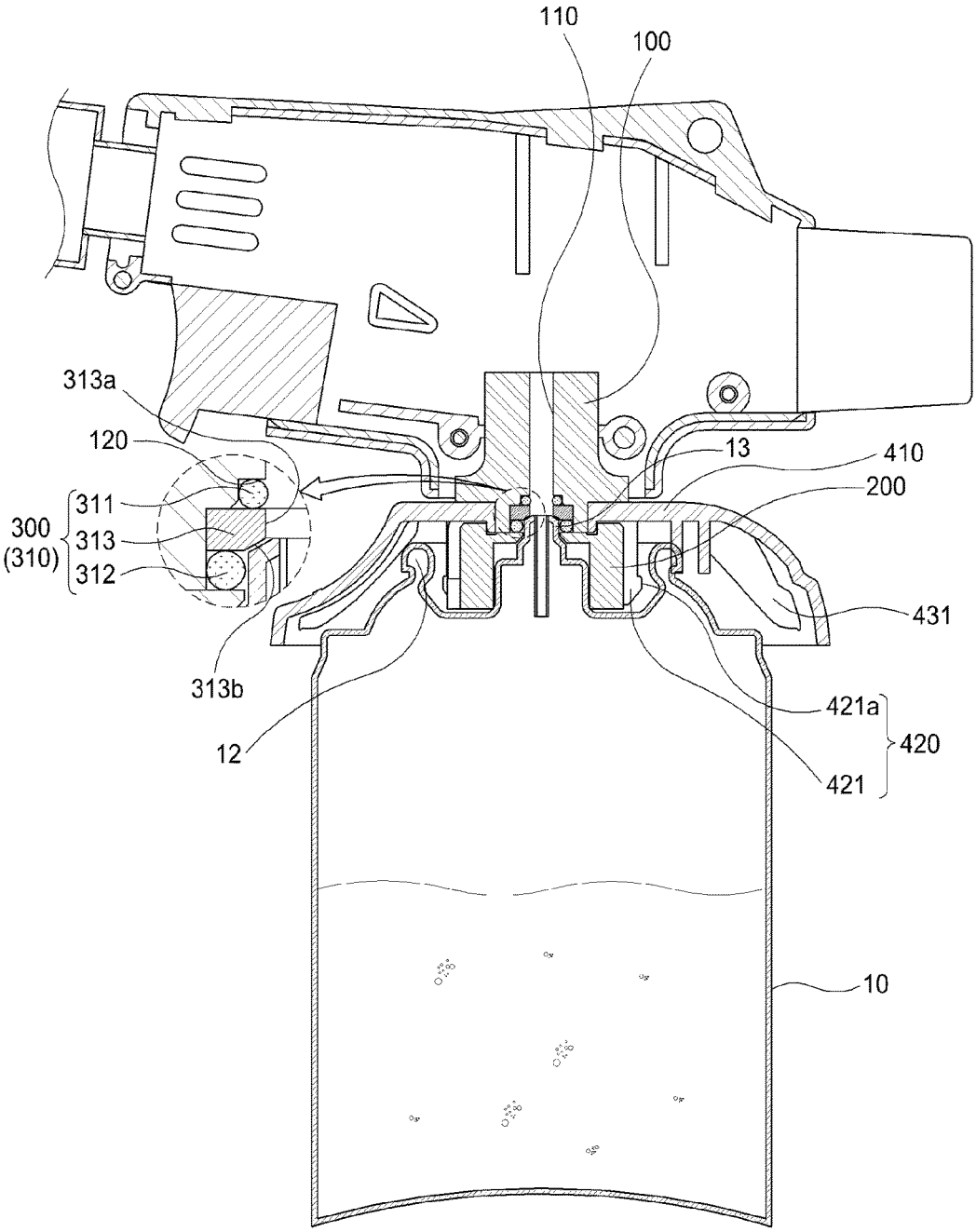
FIG. 6 is a longitudinal sectional view illustrating that a butane gas container is coupled to a gas container connecting adapter according to an embodiment of the present invention.
Figure 7:
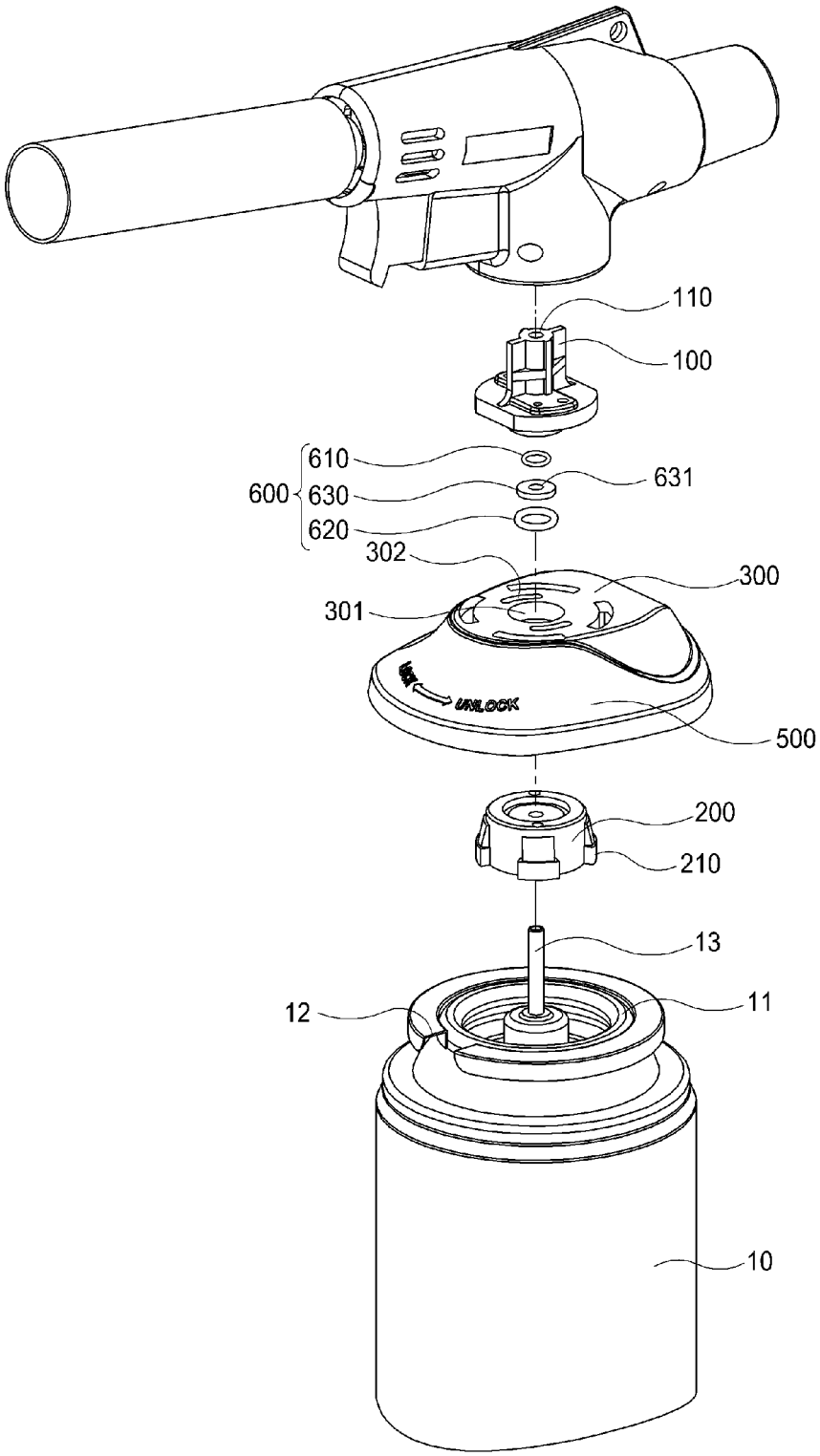
FIG. 7 is an exploded perspective view illustrating that a charging gas container is coupled to a gas container connecting adapter according to an embodiment of the present invention.
Figure 8:
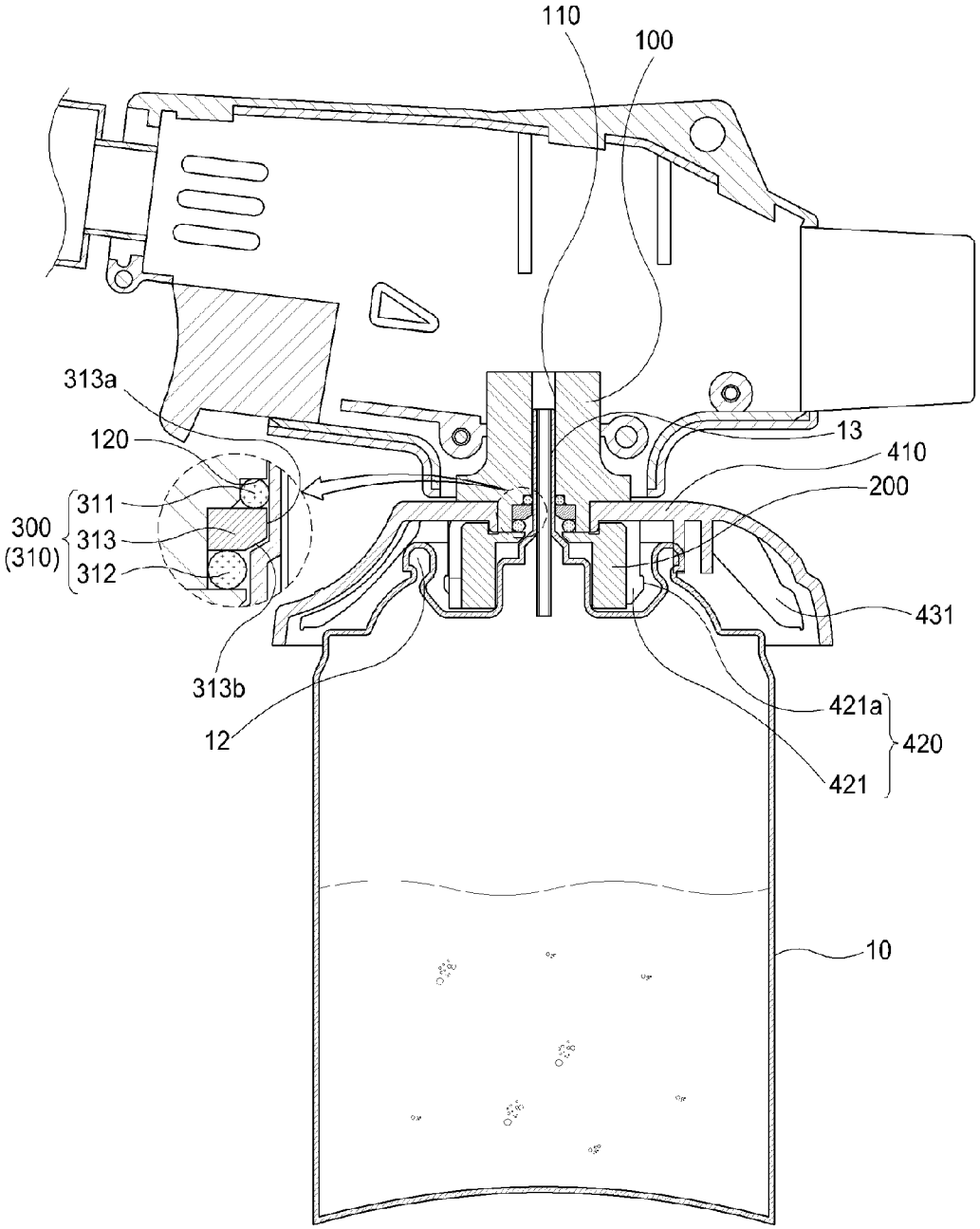
FIG. 8 is a longitudinal sectional view illustrating that a charging gas container is coupled to a gas container connecting adapter according to an embodiment of the present invention.

FIG. 3 is a perspective view illustrating a structure of a gas container connecting adapter according to an embodiment of the present invention. FIG. 4 is a perspective view illustrating an inner structure of the gas container connecting adapter shown in FIG. 3. FIG. 5 is an exploded perspective view illustrating that a butane gas container is coupled to a gas container connecting adapter according to an embodiment of the present invention. FIG. 6 is a longitudinal sectional view illustrating that a butane gas container is coupled to a gas container connecting adapter according to an embodiment of the present invention. FIG. 7 is an exploded perspective view illustrating that a charging gas container is coupled to a gas container connecting adapter according to an embodiment of the present invention. FIG. 8 is a longitudinal sectional view illustrating that a charging gas container is coupled to a gas container connecting adapter according to an embodiment of the present invention.

As shown, a gas container connecting adapter according to the present invention includes a body 100 coupled to a gas container 10 by a gas container coupling unit 200, having a gas supply passage 110, and configured to discharge gas supplied from the gas container 10; and a sealing unit 300 provided at an inlet of the gas supply passage 110, configured to prevent gas supplied from the gas container 10 coupled to the gas container coupling unit 200, from leaking to the outside of the gas supply passage 110, and having a plurality of sealing means 310 selectively contacting a nozzle 13 of the gas container 10 according to a shape of the nozzle 13.

The gas container 10 is provided with, on an upper surface thereof, a locking ring 11 for coupling with the gas container connecting adapter. A cut-out groove 12, implemented as part of the gas container 10 is cut-out, is formed at an upper outer surface. The nozzle 13, serving as a passage along which gas is injected to the outside, is provided at a central part of an upper surface of the gas container 10.

The gas container 10, generally used at home, may be configured as a butane gas container having the cut-out groove 12 and having the relatively short and thick nozzle 13. Alternatively, the gas container 10 may be configured not to have the cut-out groove 12, but to have the relatively long and thin nozzle 13 so as to supply gas to a lighter, etc.

A fuel injection pipe is extendingly-formed at one side of a body of the gas injection device. The body serves to heat an object to be heated by combusting gas injected through the fuel injection pipe, and by generating flame at an end part thereof.

The body 100 is a member mounted in the gas injection device. The gas supply passage 110, a passage along which gas is supplied, is penetratingly-formed at a central part of the body 100. An accommodation groove 120, configured to accommodate therein a first O-ring 311, is formed at an inner lower side of the body 100.

Preferably, the accommodation groove 120 is formed such that its diameter has the same length as an outer diameter of the first O-ring 311, for prevention of movement of the first O-ring 311 accommodated in the accommodation groove 120.

The gas container coupling unit 200, provided at one side of the body 100, may be configured as a plurality of coupling members protruding from an outer surface of a ring-shaped member in a spaced manner by a predetermined gap. Alternatively, the gas container coupling unit 200 may be configured as a member having an entire oval shape.

The sealing means 310 of the sealing unit 300 include a first O-ring 311 disposed at an upper side so as to contact a nozzle formed to be relatively short and thin, and formed to have a relatively small diameter; and a second O-ring 312 disposed below the first O-ring 311 so as to contact a nozzle formed to be relatively long and thick, and formed to have a relatively large diameter.

A separation preventing plate 313, which has a nozzle insertion hole 313*a* penetratingly-formed at a central part thereof, is provided between the first O-ring 311 and the second O-ring 312 for prevention of separation of the first O-ring 311.

A lower circumferential surface of the nozzle insertion hole 313*a* formed at a central part of the separation preventing plate 313, is preferably provided with an inclined surface 313*b* formed to be tapered in order to prevent an upper surface of the nozzle 13 being inserted from being locked to a circumferential surface of the nozzle insertion hole 313*a*.

The gas container connecting adapter further includes an upper surface unit 410 rotatably installed between the body 100 and the gas container coupling unit 200; a lock unit 420 downward protruding from a lower surface of the upper surface unit 100 and disposed at a circumference of the gas container coupling unit 200, and selectively locked to the locking ring 11 provided on an upper surface of the gas container 10, by having position change between a lock position and an unlock position by a relative rotation with respect to the gas container coupling unit 200; and a grasping unit 430 downward extending from a circumferential part of the upper surface unit 410 by a predetermined length, and configured to rotate the upper surface unit 410 such that the lock unit 420 is relatively rotatable with respect to the gas container coupling unit 200.

The upper surface unit 410 is formed to be flat, and is rotatably provided between the body 100 and the gas container coupling unit 200. A nozzle hole 410*a* for inserting the nozzle 13 of the gas container 10 is penetratingly-formed at a central part of the upper surface unit 410.

A through hole 410*b*, for passing through a fixing screw for fixing the gas container coupling unit 200 such that the upper surface unit 410 is rotatably coupled between the body 100 and the gas container coupling unit 200, is formed at a circumferential part of the nozzle hole 410*a*, in an arc shape.

The lock unit 420 is composed of a plurality of locking members 421 spaced from each other with a constant interval therebetween on the same circumference as the locking ring 11 of the gas container 10. Locking jaws 421*a*, locked to the locking ring 11 when the lock unit 420 is disposed on a lock position, are protruding from a lower outer surface of the locking members 421.

On the lock position, the locking members 421 are disposed to be overlapped with the gas container coupling unit 200, and a lower part thereof is widened to the outside. As a result, the locking members 421 are locked to the locking ring 11. For this, the gas container coupling unit 200 is provided with additional coupling members, or the gas container coupling unit 200 is formed to have an oval shape such that a lower part of the locking members 421 is selectively widened to the outside. In the gas container connecting adapter according to an embodiment of the present invention, the gas container coupling unit 200 is provided with coupling members.

The locking members 421 are arranged to face each other, and are preferably provided in plurality like the coupling members so as to uniformly distribute a coupling force between the gas container coupling unit 200 and the gas container 10, and so as to enhance the coupling force.

Stoppers 421*b*, locked to one side of the gas container coupling unit 200 so as to restrict rotation of the locking members 421, are protruding from an inner surface of the locking members 421.

The stoppers 421*b* are members inward protruding by extending from an inner surface of one end of the locking members 421 in a height direction of the locking members 421, such that a complete overlapped state between the locking members 421 and the coupling members of the gas container coupling unit 200 is maintained.

A position determination member 411, inserted into the cut-out groove 12 of the gas container 10 when the gas container 10 is coupled to the gas container connecting adapter, is protruding from one side of a lower surface of the upper surface unit 410. The position determination member 411 facilitates coupling of the gas container 10 to the gas container connecting adapter, by inserting the gas container 10 into the gas container connecting adapter on an original position.

An arrow indicating a position of the position determination member 411 may be printed onto an upper surface of the upper surface unit 410. Preferably, the upper surface unit 410 and the grasping unit 430 are formed of a transparent material such that a position of the position determination member 411 is easily checked.

The grasping unit 430 may be disposed in an inclined state so as to be gradually widened toward a lower side, in a thickness direction of the upper surface unit 410. With such a configuration, a user can easily rotate the gas container connecting adapter using the grasping unit 430, in a state where the gas container 10 has been inserted into the gas container connecting adapter. Further, a user's sense of grip can be enhanced.

A plurality of reinforcing ribs 431 are provided on an inner surface of the grasping unit 430, so that the grasping unit 430 is prevented from being transformed when a user rotates the gas container connecting adapter using the grasping unit 430. One side surface of the reinforcing ribs 431 is fixed to a lower surface of the upper surface unit 410, and another side surface thereof is fixed to an inner surface of the grasping unit 430.

Hereinafter, processes to couple a gas container to the gas container connecting adapter according to an embodiment of the present invention will be explained.

In case of a butane gas container having a short and thick nozzle, the gas container 10 is fitted into the gas container connecting adapter from a lower side to an upper side, such that the position determination member 411 is inserted into the cut-out groove 12 formed on an upper surface of the gas container 10, and such that the gas container 10 contacts a lower surface of the gas container coupling unit 200.

Under this state, if the upper surface unit 410 is rotated by a predetermined angle by using the grasping unit 430, the locking members 421 are disposed at an overlapping position with the gas container coupling unit 200, and a lower end of the locking members 421 is widened to the outside. As a result, the locking jaws 421*a* are locked to the locking ring 11 of the gas container 10, thereby completing the coupling of the gas container 10.

Once the gas container 10 is completely coupled to the gas container connecting adapter, the nozzle 13 of the gas container 10 comes in contact with the second O-ring 312, so that a sealed state is maintained. Thus, gas supplied from the gas container 10 is prevented from leaking to the outside.

If the gas container 10 is completely coupled to the gas injection device by the above processes, an ignition process is performed in a state where a fuel supply control nozzle provided at one side of the gas injection device is open. As a result, an object to be heated is heated by using the gas injection device.

After the gas injection device is completely used, the above processes are executed in reverse so that the gas container 10 is separated from the gas injection device to thus be stored separately.

In case of a butane gas container having a long and thin nozzle, the cut-out groove 12 is not formed on an upper surface of the gas container 10. Thus, in a state where the gas container 10 is inserted into the gas container connecting adapter from a lower side to an upper side, the upper surface unit 410 is rotated by a predetermined angle by using the grasping unit 430 of the gas container connecting adapter.

If the grasping unit 430 is rotated by a predetermined angle, the locking members 421 are disposed at an overlapping position with the gas container coupling unit 200, and a lower end of the locking members 421 is widened to the outside. As a result, the locking members 421 are locked to the locking ring 11 of the gas container 10, so that the gas container 10 is coupled to the gas container connecting adapter.

Once the gas container 10 is completely coupled to the gas container connecting adapter, the nozzle 13 of the gas container 10 comes in contact with the first O-ring 311, so that a sealed state is maintained. Thus, gas supplied from the gas container 10 is prevented from leaking to the outside.

If the gas container 10 is completely coupled to the gas container connecting adapter by the above processes, an ignition process is performed in a state where a fuel supply control nozzle provided at a gas injection device is open. As a result, an object to be heated is heated by using the gas injection device.

After the gas injection device is completely used, the above processes are executed in reverse so that the gas container 10 is separated from the gas injection device to thus be stored separately.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A gas container connecting adapter, comprising:

a body (100) capable of being coupled to a gas container (10) by a gas container coupling unit (200), having a gas supply passage (110), and configured to discharge gas supplied from the gas container (10); and a sealing unit (300) provided at an inlet of the gas supply passage (110), configured to prevent gas supplied from the gas container (10) coupled to the gas container coupling unit (200), from leaking to outside of the gas supply passage (110), and having a plurality of sealing means (310) selectively contacting a nozzle (13) of the gas container (10) according to shape and size of the nozzle (13), the plurality of sealing means (310) including a first O-ring (311) and a second O-ring disposed below the first O-ring (311), the second O-ring having a diameter larger than that of the first O-ring;

an upper surface unit (410) rotatably installed between the body (100) and the gas container coupling unit (200);

a lock unit (420) downward protruding from a lower surface of the upper surface unit (410) and disposed at a circumference of the gas container coupling unit (200), and selectively locked to the locking ring (11) provided on an upper surface of the gas container (10), by having position change between a lock position and an unlock position by a relative rotation with respect to the gas container coupling unit (200); and a grasping unit (430) downward extending from a circumferential part of the upper surface unit (410) by a predetermined length, and configured to rotate the upper surface unit (410) such that the lock unit (420) is relatively rotatable with respect to the gas container coupling unit (200).

2. The gas container connecting adapter of claim 1, wherein a separation preventing plate (313), which has a nozzle insertion hole (313*a*) penetratingly-formed at a central part thereof, is provided between the first O-ring (311) and the second O-ring (312) for prevention of separation of the first O-ring (311).

3. The gas container connecting adapter of claim 2, wherein a lower circumferential surface of the nozzle insertion hole (313*a*) is provided with an inclined surface (313*b*) formed to be tapered in order to prevent an upper surface of the nozzle (13) being inserted from being locked to a circumferential surface of the nozzle insertion hole (313*a*).

* * * * *